US007357642B2

(12) United States Patent
Masubuchi et al.

(10) Patent No.: US 7,357,642 B2
(45) Date of Patent: Apr. 15, 2008

(54) CARD CONNECTOR

(75) Inventors: Tadashi Masubuchi, Tokyo (JP); Hirokazu Takahashi, Tokyo (JP)

(73) Assignee: DDK, Ltd, Tokyo (JP)

( * ) Notice: Subject to any disclaimer, the term of this patent is extended or adjusted under 35 U.S.C. 154(b) by 0 days.

(21) Appl. No.: 11/708,090

(22) Filed: Feb. 15, 2007

(65) Prior Publication Data

US 2007/0190817 A1 Aug. 16, 2007

(30) Foreign Application Priority Data

Feb. 16, 2006 (JP) ..... 2006-039736

(51) Int. Cl.
*H01R 12/00* (2006.01)

(52) U.S. Cl. ..... 439/64

(58) Field of Classification Search ..... 439/64, 439/159, 360, 377, 633, 607
See application file for complete search history.

(56) References Cited

U.S. PATENT DOCUMENTS 7,108,557 B2 * 9/2006 Kikuchi et al. ..... 439/630
7,261,577 B1 * 8/2007 Lai ..... 439/159
2006/0189186 A1 * 8/2006 Lin ..... 439/159

FOREIGN PATENT DOCUMENTS

JP 2000-058197 2/2000
JP 2003-208935 7/2003

* cited by examiner

*Primary Examiner*—Phuong Dinh
(74) *Attorney, Agent, or Firm*—Abelman, Frayne & Schwab

(57) ABSTRACT

A card connector into and from which a card is inserted and removed, includes a plurality of contacts each having a contact portion to contact the card, a housing arranging and holding the contacts and having a fitting opening for inserting the card, a guide frame formed integrally with or separately from the housing and having guide portions for guiding the card to the contacts, a shell enclosing that part of the guide frame in which removing device is installed for removing the card from the card connector, and terminals arranged on the side of the leading end of the fitting opening for preventing troubles caused by static electricity. One of the terminals is provided with an extending piece extending onto the side opposite from the connection portion to be connected to a substrate. The shell is provided with an extending portion adapted to contact the extending piece. The card connector thus constructed is free from secondary discharge.

2 Claims, 10 Drawing Sheets

CARD CONNECTOR

BACKGROUND OF THE INVENTION

This invention relates to a card connector for use in electric and electronic appliances such as personal computers, printers and the like, and more particularly to a card connector with a structure for preventing troubles caused by electro-static discharge (ESD).

There have been many kinds of cards as media for a wide variety of information. It has been a common practice to obtain or store various information from or onto a card inserted in a card connector which is connected to an information appliance.

In order to connect a card to a card connector, the card connector is provided with a fitting opening for inserting the card thereinto, and contacts having a contact portion are provided in the card connector so as to extend the contact portions into the fitting opening so that upon the card being inserted, said card is brought into contact with the contact portions of the contacts, thereby achieving continuity therebetween. As only a small portion of said card extends from said card connector, ejector means as disclosed in a Patent Literature described below has been provided in order to remove said card from said connector. Card connectors have been disclosed in the following Patent Literatures 1 and 2.

Patent Literature 1

According to the ABSTRACT of Japanese Patent Application Opened No. 2000-58,197, the invention has an object to provide an IC card connector which has a reduced overall height and is simple in construction and which is able to be readily changed from standard mounting to reverse mounting and has a variable standoff state. An IC card connector having the following construction is disclosed. A frame portion 2 includes a pair of guide frames 3 made of a synthetic resin and a metal bridge 4 connecting one ends of the guide frames 3 so that the frame portion 2 is substantially U-shaped. Incorporated in the bridge are a lever 5 and a plate 6 which form part of an ejector mechanism for removing the IC card. An ejector button 8 is slidably mounted on one of the guide frames. When the ejector button 8 is slidably moved, the lever is rotated to cause the plate to be slid, thereby ejecting the IC card from the IC card connector. In order to prevent the IC card turned upside down from being inserted into the connector, one of the guide frames is formed with a thin polar key 3A, and the other guide frame is formed with a thick polar key, and both the guide frames are in symmetry except for the polar keys so that the guide frames on the left and right sides can be changed with each other.

In connection therewith, claim 1 of the Japanese Patent Application Opened No. 2000-58,197 recites an IC card connector comprising a frame portion including a pair of guide frames made of a synthetic resin and a metal bridge connecting one ends of said guide frames so that said frame portion is substantially U-shaped, a lever and a plate incorporated in said bridge as part of an ejector mechanism for ejecting the IC card from the connector, and an ejector button slidably mounted on one of said guide frames for causing said lever to rotate, thereby ejecting said IC card by a sliding movement of said plate caused by rotation of said lever. Claim 2 recites an IC card connector whose frame portion including a pair of guide frames made of a synthetic resin and a metal bridge connecting one ends of said guide frames so that said frame portion is substantially U-shaped, and the pair of guide frames made of the synthetic resin of said substantially U-shaped frame portion are each formed with a polar key on the side opposite from an opening portion, said polarities of the keys being different from each other, for preventing an IC card turned upside down from being inserted, while said pair of guide frames are configured in symmetry except for said polar keys so that said guide frames on the left and right sides can be changed with each other. Claim 3 recites an IC card connector whose frame portion including a pair of guide frames made of a synthetic resin and a metal bridge connecting one ends of said guide frames so that said frame portion is substantially U-shaped, and the pair of guide frames made of the synthetic resin of said substantially U-shaped frame portion each having an earth lug incorporated therein, said earth lugs having a hook pin integrally formed therewith for anchoring said earth lugs to a printed substrate. Claim 4 recites the IC card connector as set forth in claim 3 including said earth lugs each having a positioning portion as its integral part adapted to abut against said printed substrate, and heights of said hook pins and said positioning portions being variable.

Patent Literature 2

According to the ABSTRACT of Japanese Patent Application Opened No. 2003-208,935, the invention has an object to provide a connector which is never bent or dislodged from a substrate upon impact. The connector comprises contacts 10, an insulator 20 for holding the contacts, and fixing members 30 fixed to a substrate for holding the insulator 20 mounted on said substrate 120, thereby enabling a connection object to be moved in a connection direction A so as to be connected to said contacts 10 and to be moved in a disconnection direction B so as to be disconnected from said contacts 10, wherein said fixing members 30 each comprise an abutment surface 30*c* extending from an opposite surface 20*a* of said insulator in said disconnection direction so that said abutment surface 30*c* abuts against the end face of said connection object on the side of said connection direction.

In connection therewith, claim 1 of the Japanese Patent Application Opened No. 2003-208,935 recites a connector including electrically conductive contacts, an insulator for holding said contacts, and fixing members fixed to a substrate for holding said insulator mounted on said substrate, thereby enabling a connection object to be moved in a connection direction so as to be connected to said contacts and to be moved in a disconnection direction opposite to the connection direction so as to be disconnected from said contacts, wherein said fixing members each comprise an abutment surface facing to the end face of said connection object and extending from an opposite surface of said insulator in said disconnection direction so that said abutment surface abuts against the end face of said connection object on the side of said connection direction when said connection object is being moved in said connection direction to bring it into contact with said contacts. Claim 2 recites the connector as set forth in claim 1 including said fixing members each comprising a press-fitting portion in the form of a plate-shape adapted to be press-fitted into said insulator and a fixed portion in the form of a plate-shape adapted to be fixed to said substrate, said abutment surface being one in its thickness direction which extends across the plate surface of said fixing member.

Static electricity will be frequently accumulated in cards generally used. When a card with the stored static electricity is brought into contact with contacts of a connector, the stored static electricity is liable to cause short circuit and malfunctionings of the connector and peripheral equipment. In usual, therefore, a contact (terminal) is used as an approach to preventing the troubles caused by the stored static electricity so that before contacting between the card and said contacts, the card is brought into contact with the contact (terminal) for this approach to discharge the static electricity through the contact (terminal) to a frame ground (FG) or substrate as in the Patent Literatures described above.

With the configurations disclosed in the Patent Literatures, however, there have been many cases that the stored static electricity would discharge at clearances between the contact (terminal) for this approach and metal bridges (so-called secondary discharge), before it discharges from the contact (terminal) to the frame ground (FG) or a substrate. The secondary discharge leads to occurrence of noise which disturbs the signal line, resulting in malfunctioning of the card. This problem remains to be solved.

SUMMARY OF THE INVENTION

In view of the problems of the prior art described above, it is an object of the invention to provide a card connector having a construction enabling the secondary discharge of static electricity to be prevented.

The object of the invention as described above can be accomplished by the card connector 10 into and from which a card 60 is inserted and removed, according to the invention, including a plurality of contacts 14 each having a contact portion 141 adapted to contact said card 60, a housing 12 arranging and holding said contacts 14 and having a fitting opening 28 into which said card 60 is inserted, a guide frame 16 formed integrally with or separately from said housing 12 and having guide portions for guiding said card 60 to said contacts 14, a shell 18 enclosing that part of said guide frame 16 in which removing means is installed, terminals 20 arranged on the side of the leading end of said fitting opening 28 for preventing troubles caused by static electricity, and the removing means for removing said card 60 from said card connector 10, wherein at least one of said terminals 20 is provided with an extending piece 201 extending onto the side of the terminal opposite from its connection portion to be connected to a substrate, and said shell 18 is provided with an extending portion 182 adapted to contact said extending piece 201.

According to a preferred embodiment, said shell 18 is further provided with an extending portion 182 on the side opposite from said extending piece 201 for preventing said terminal 20 from tilting.

As can be seen from the above description the card connector 10 according to the invention can bring about the following significant functions and effects.

(1) In an card connector 10 into and from which a card 60 is inserted and removed, including a plurality of contacts 14 each having a contact portion 141 adapted to contact said card 60, a housing 12 arranging and holding said contacts 14 and having a fitting opening 28 into which said card 60 is inserted, a guide frame 16 formed integrally with or separately from said housing 12 and having guide portions for guiding said card 60 to said contacts 14, a shell 18 enclosing that part of said guide frame 16 in which removing means is installed, terminals 20 arranged on the side of the leading end of said fitting opening 28 for preventing troubles caused by static electricity, and the removing means for removing said card 60 from said card connector 10, according to the invention at least one of said terminals 20 is provided with an extending piece 201 extending onto the side of the terminal opposite from its connection portion to be connected to a substrate, and said shell 18 is provided with an extending portion 182 adapted to contact said extending piece 201. Accordingly, the secondary discharge can be reliably prevented and hence no noise occurs so that malfunctioning of the card can be prevented.

(2) According to the invention, said shell 18 is further provided with an extending portion 182 on the side opposite from said extending piece 201 for preventing said terminal 20 from tilting. Consequently, said extending piece 201 of said terminal 20 can be securely brought into contact with said extending portion 182 of said shell 18 to prevent the secondary discharge.

The invention will be more fully understood by referring to the following detailed specification and claims taken in connection with the appended drawings.

DESCRIPTION OF THE PREFERRED EMBODIMENTS

Figure 1A:
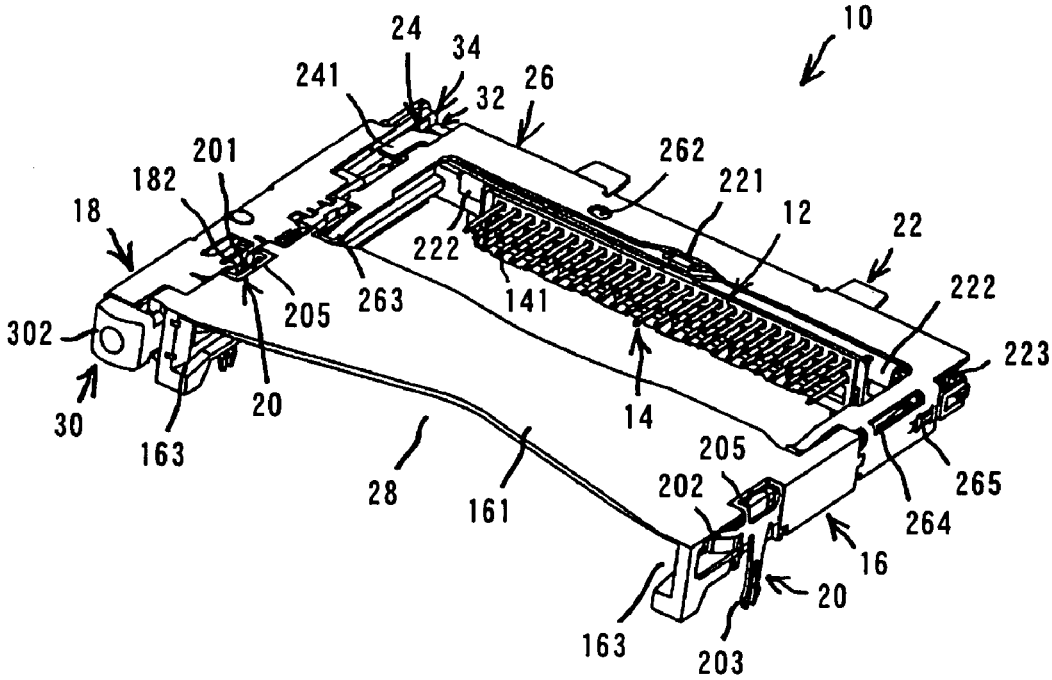
FIG. 1A is a perspective view of the card connector according to the invention viewed from the above on the side where a card is inserted.
Figure 1B:
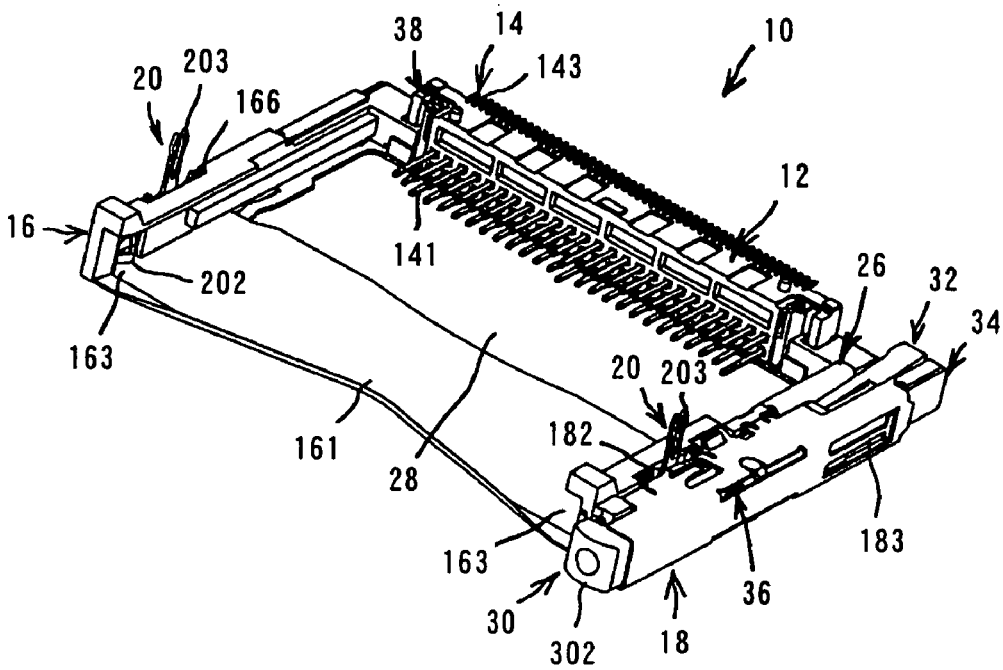
FIG. 1B is a perspective view of the card connector according to the invention viewed from the below on the side where a card is inserted.
Figure 2A:
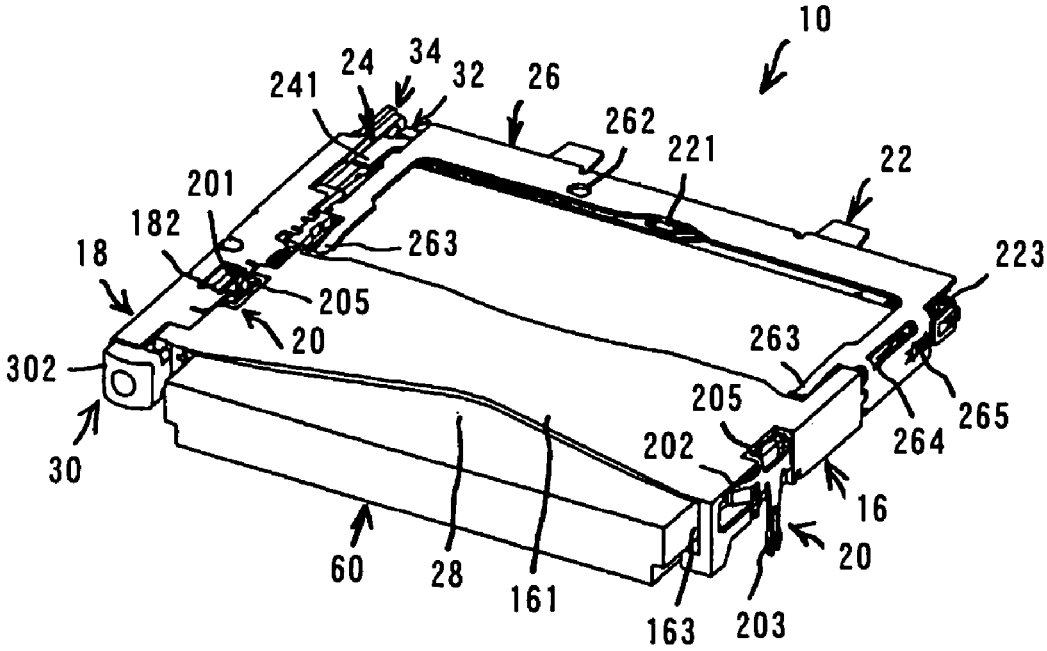
FIG. 2A is a perspective view of the card connector according to the invention with a card inserted, viewed from the above on the side where the card is inserted.
Figure 2B:
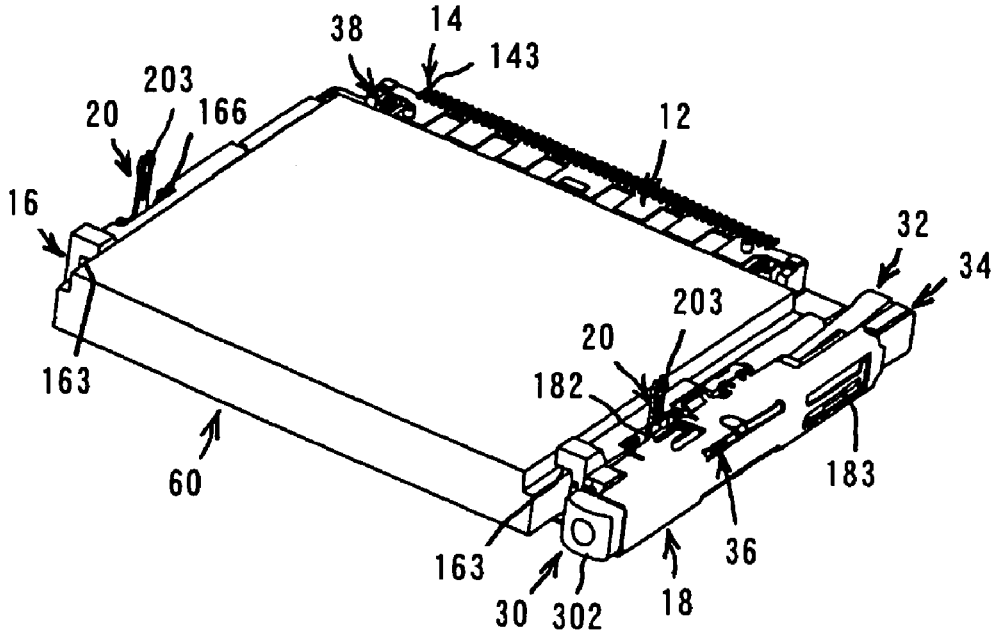
FIG. 2B is a perspective view of the card connector shown in FIG. 2A viewed from the below on the side where the card is inserted.
Figure 3:
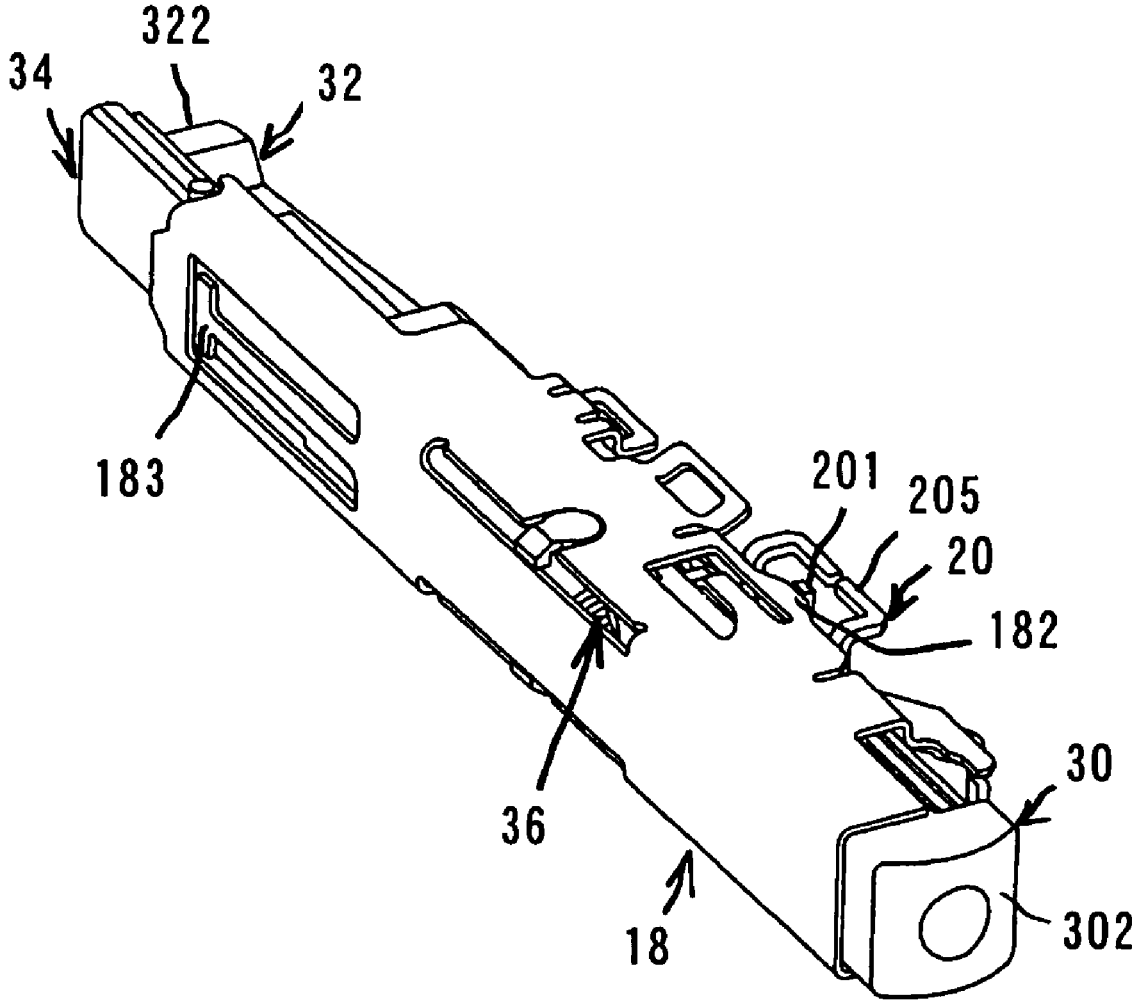
FIG. 3 is a partly enlarged perspective view of a shell for use in the card connector according to the invention, which incorporates therein an ejector button, a cam pin frame, a heart cam plate, and an elastic body, and is in contact with a terminal.
Figure 4A:
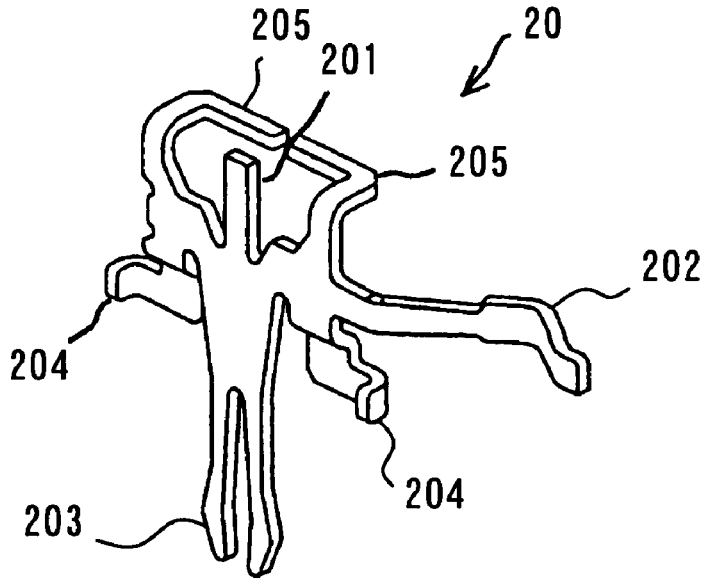
FIG. 4A is a perspective view of the terminal held by the shell.
Figure 4B:
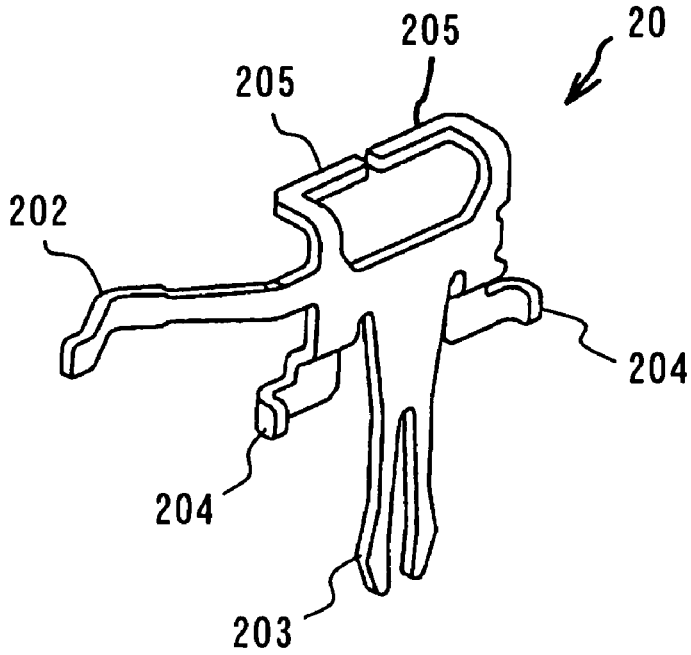
FIG. 4B is a perspective view of a terminal held on the opposite side of the shell.
Figure 5:
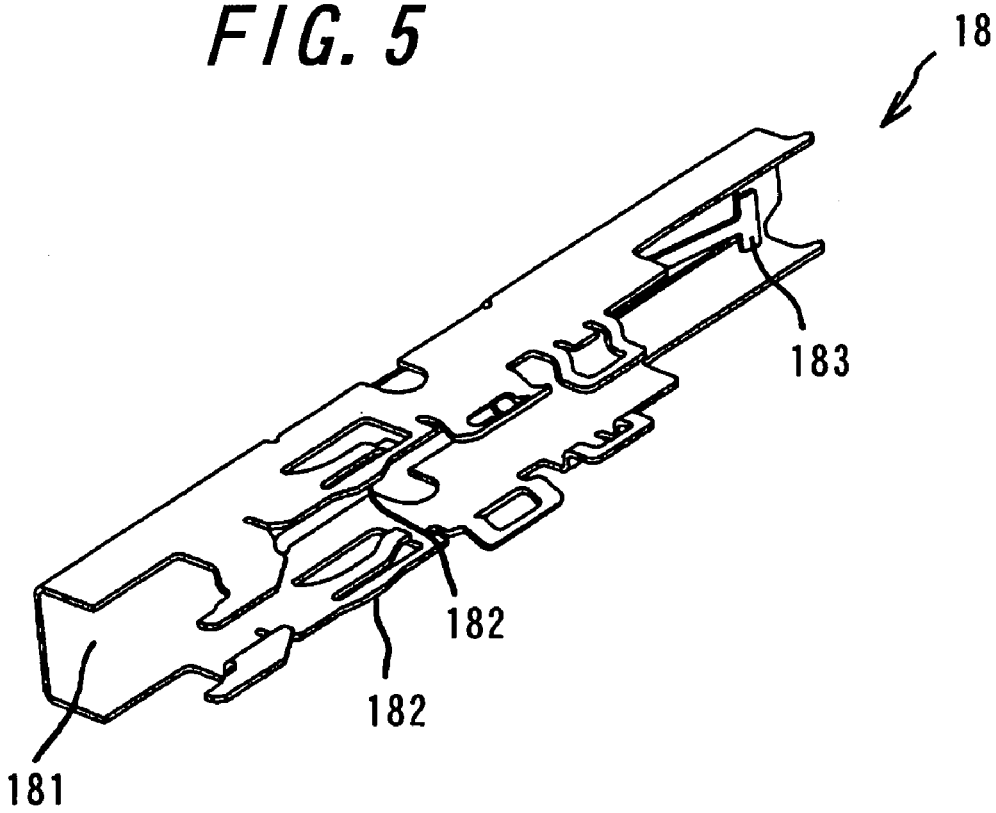
FIG. 5 is a perspective view of the shell.
Figure 6:
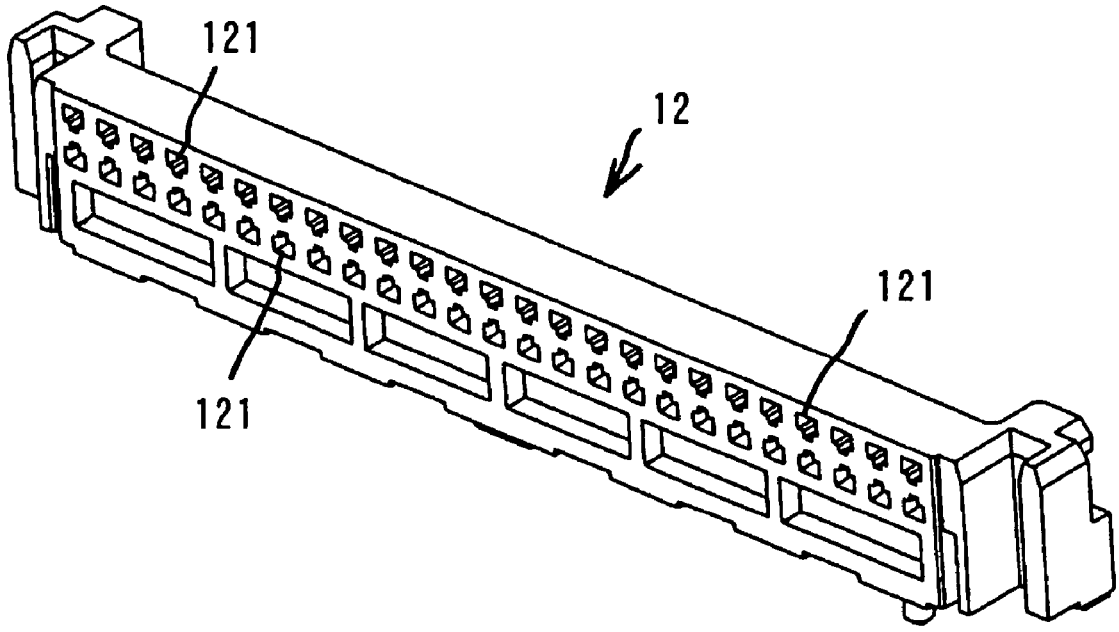
FIG. 6 is a perspective view of a housing.
Figure 7:
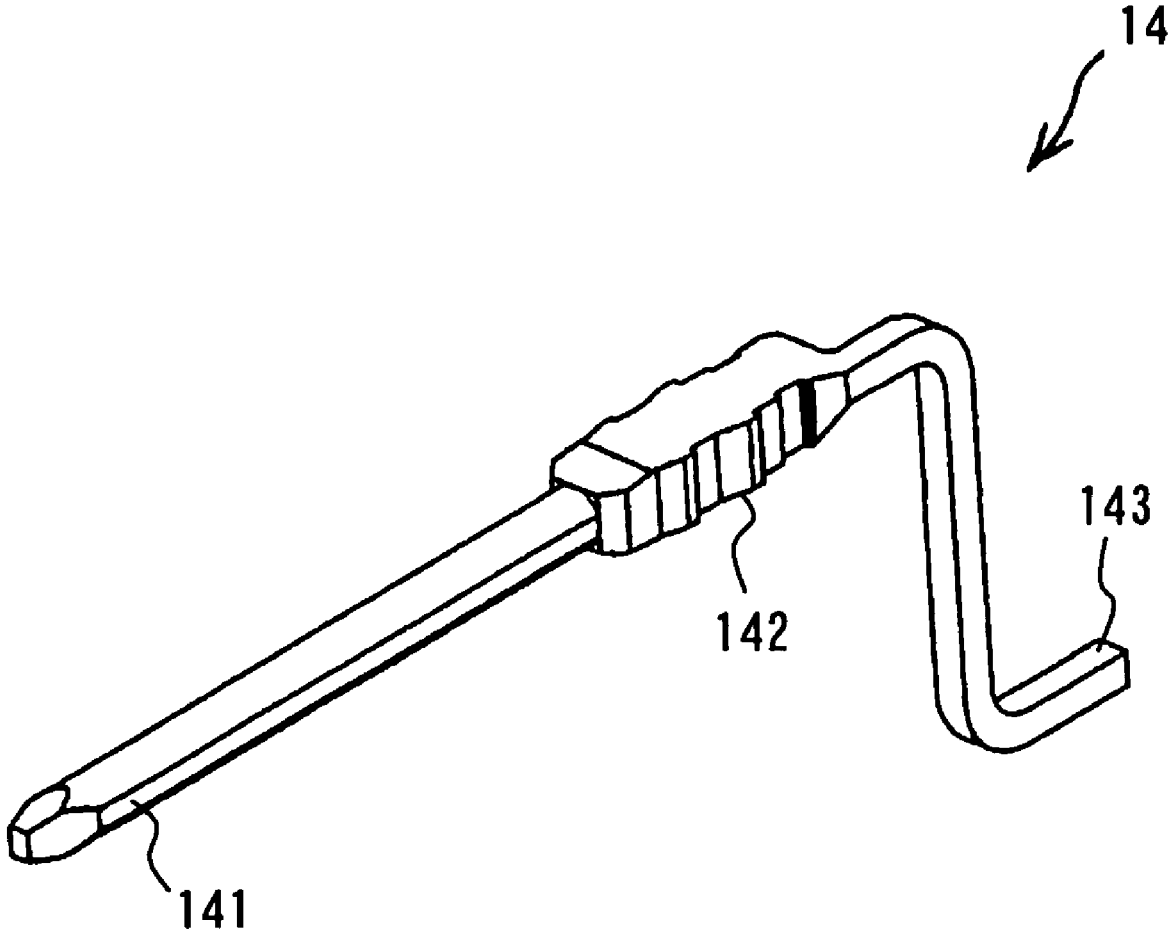
FIG. 7 is a perspective view of a contact.
Figure 8A:
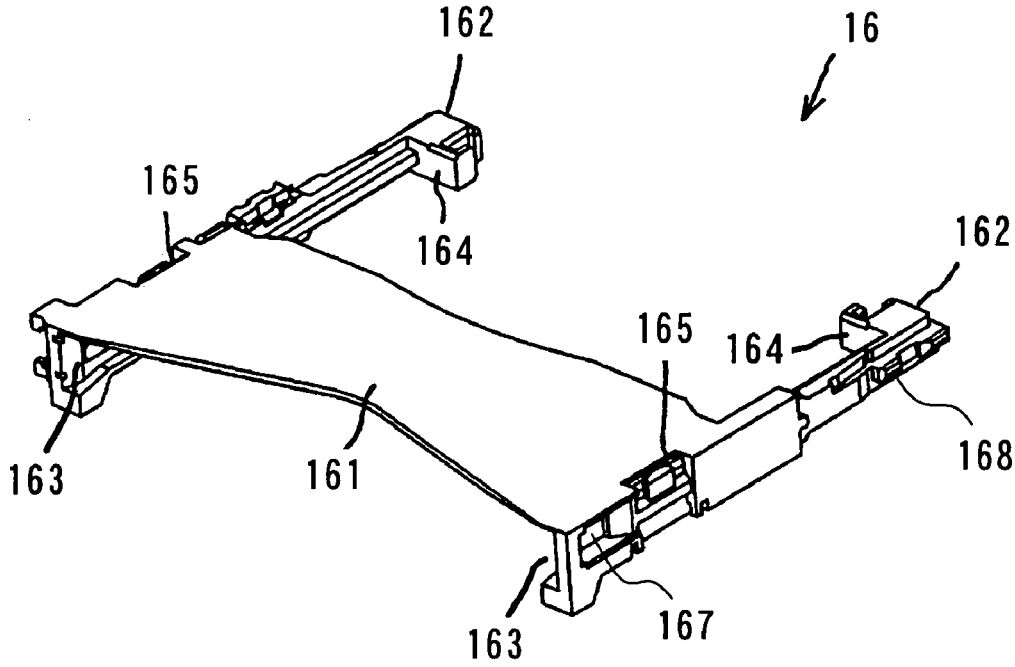
FIG. 8A is a perspective view of a guide frame viewed from the above on the side of the fitting opening.
Figure 8B:
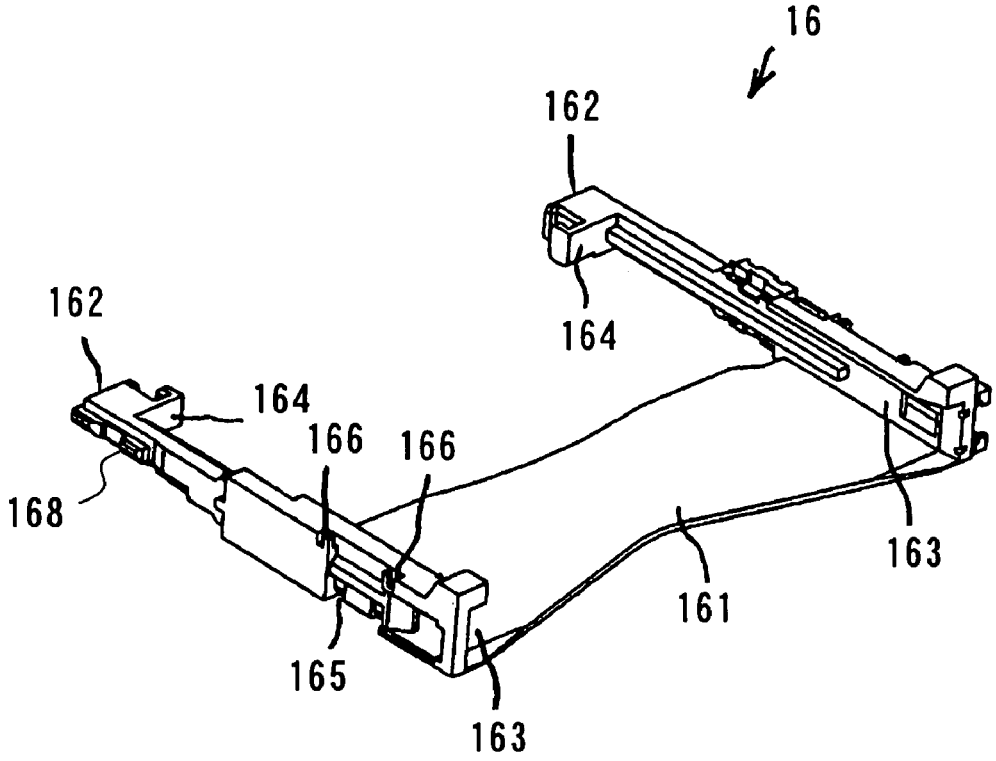
FIG. 8B is a perspective view of the guide frame viewed from the below on the side of the fitting opening.
Figure 9:
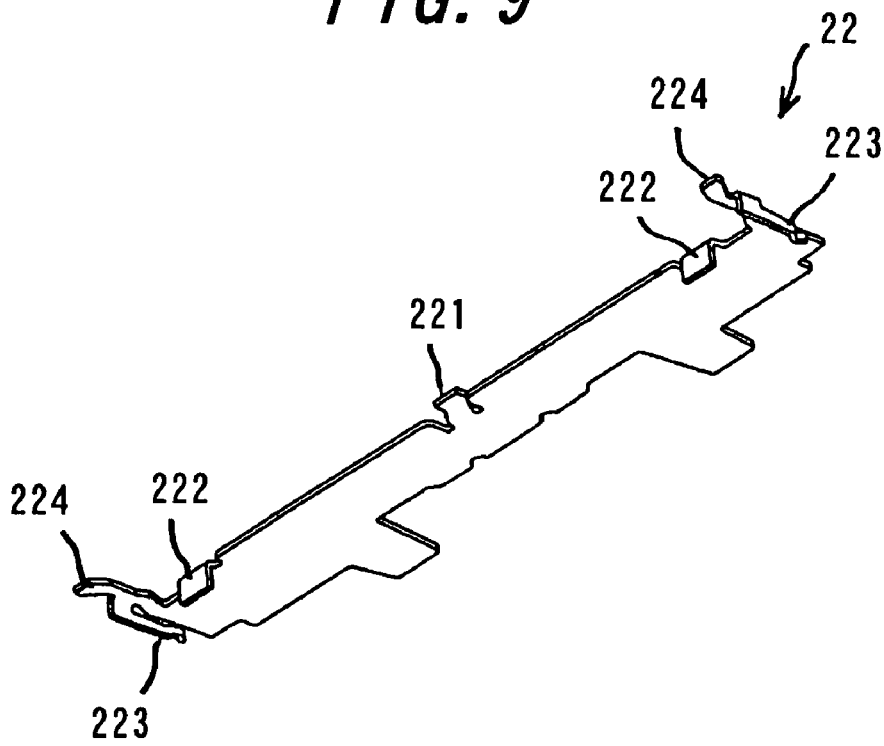
FIG. 9 is a perspective view of a slider plate.
Figure 10:
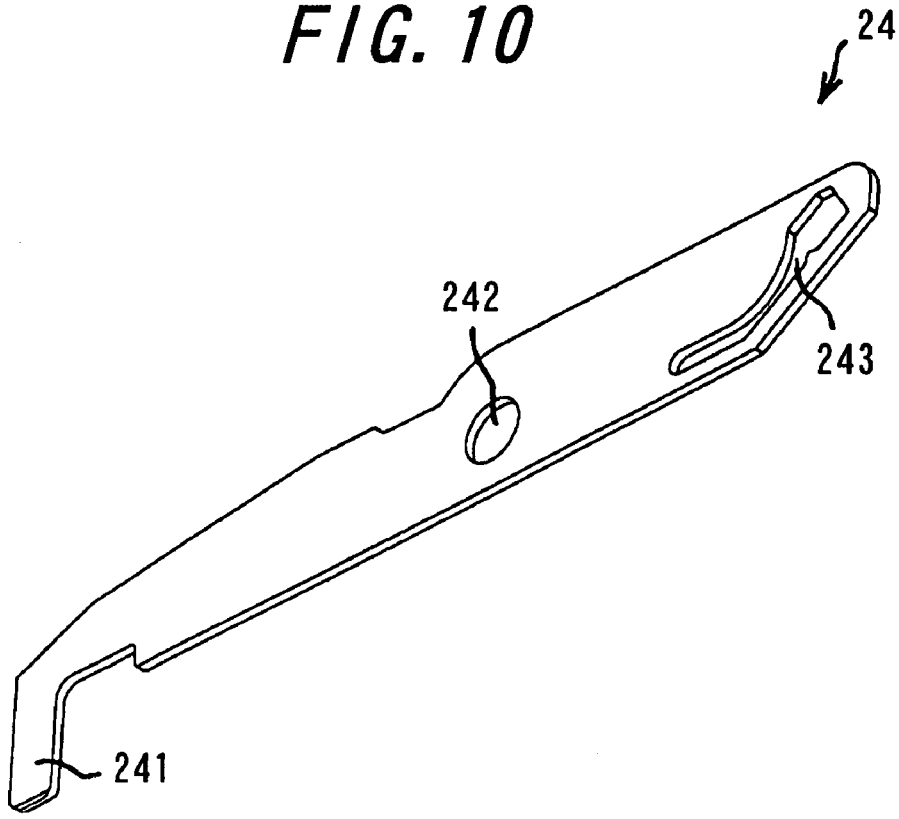
FIG. 10 is a perspective view of a slider arm.
Figure 11:
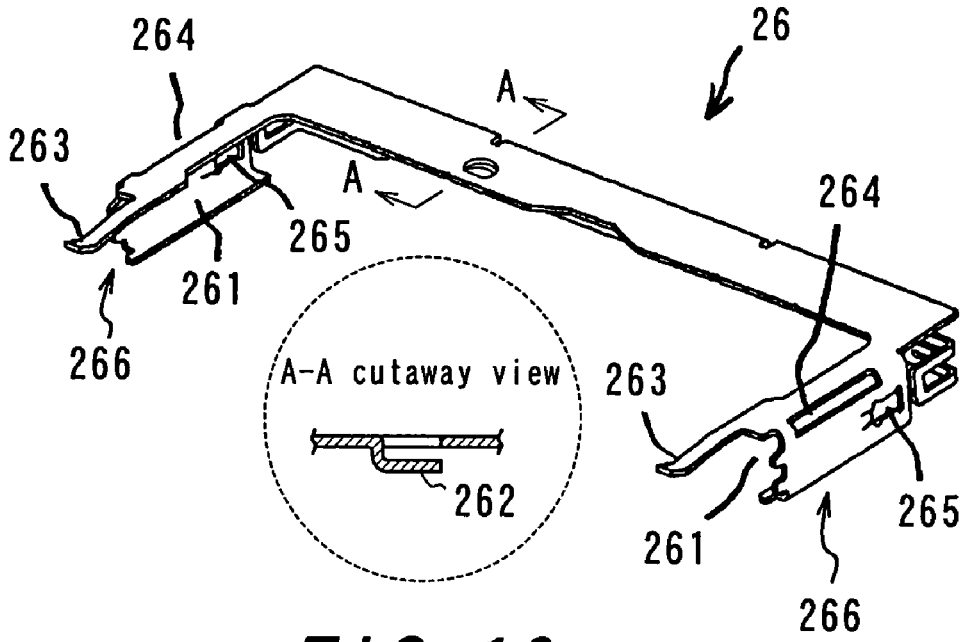
FIG. 11 is a perspective view of a metal frame.
Figure 12:
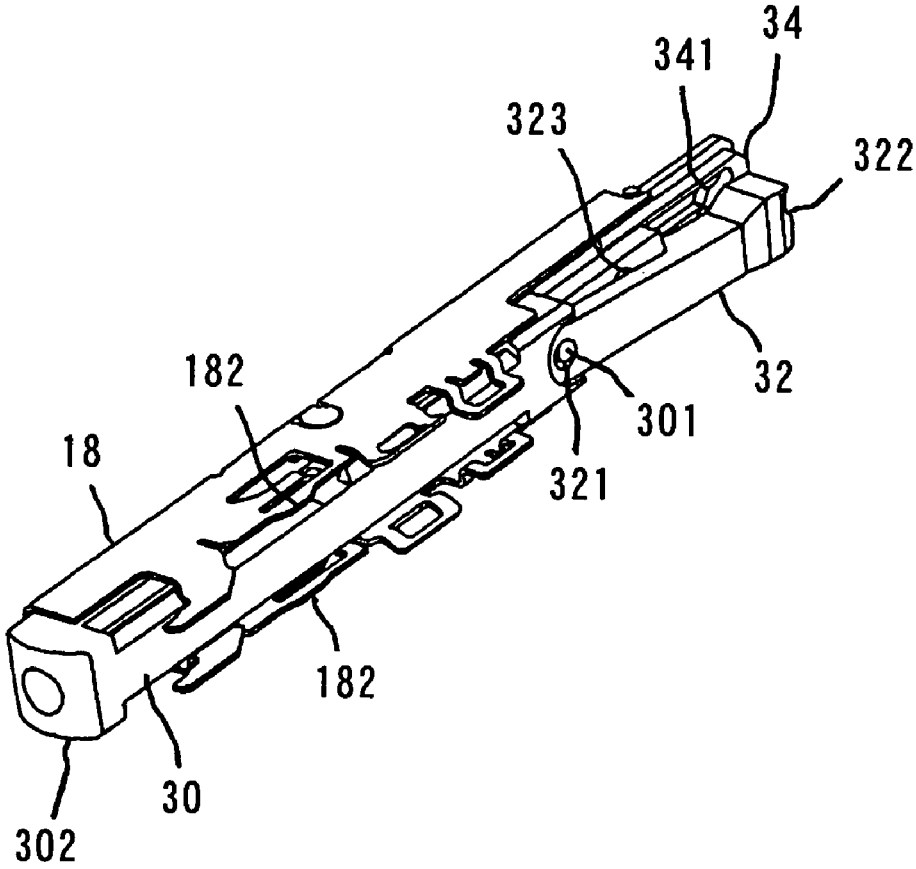
FIG. 12 is a perspective view of the shell with the ejector button, the cam pin frame, the heart cam plate and the elastic body incorporated therein.
Figure 13:
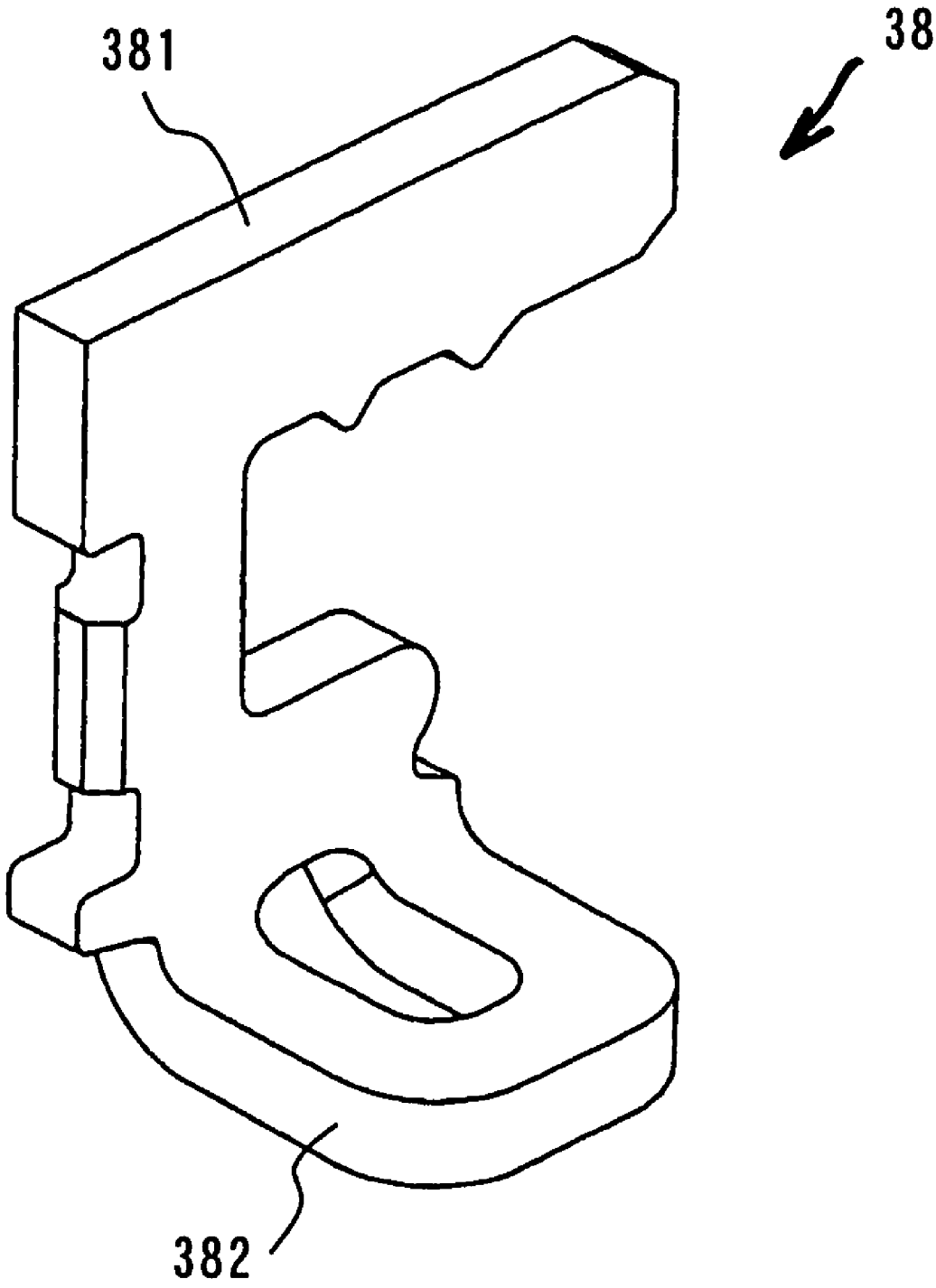
FIG. 13 is a perspective view of a fixture.

One embodiment of the card connector according to the invention will be explained with reference to FIGS. 1A to 13. The card connector according to the embodiment is configured to receive a CompactFlash card (registered trademark). FIG. 1A is a perspective view of the card connector according to the invention viewed from the above on the side where the card is inserted, and FIG. 1B is a perspective view of the card connector shown in FIG. 1A viewed from the below on the side where the card is inserted. FIG. 2A is a perspective view of the card connector with the card inserted, viewed from the above on the side where the card is inserted, and FIG. 2B is a perspective view of the card connector shown in FIG. 2A viewed from the below on the side where the card is inserted. FIG. 3 is a partly enlarged perspective view of a shell for use in the card connector according to the invention, which incorporates therein an ejector button, a cam pin frame, a heart cam plate, and an elastic body and is in contact with a terminal. FIG. 4A is a perspective view of the terminal to be held by the shell, while FIG. 4B is a perspective view of a terminal to be held on the opposite side of the terminal shown in FIG. 4A. FIG. 5 is a perspective view of the shell. FIG. 6 is a perspective view of a housing and FIG. 7 is a perspective view of a contact. FIG. 8A is a perspective view of a guide frame viewed from the above on the side of the fitting opening, while FIG. 8B is a perspective view of the guide frame viewed from the below on the side of the fitting opening. FIG. 9 is a perspective view of a slider plate, while FIG. 10 is a perspective view of a slider arm and FIG. 11 is a perspective view of a metal frame. FIG. 12 is a perspective view of the shell with the ejector button, the cam pin frame, the heart cam plate and the elastic body incorporated therein. FIG. 13 is a perspective view of a fixture.

The card connector 10 according to the invention at least comprises contacts 14, a housing 12, card removing means, a shell 18, terminals 20, and a guide frame 16.

Before explaining the components of the card connector, the cards 60 will be explained. The cards 60 are used for printers, card readers and the like. The cards 60 each mainly comprise contact portions adapted to contact the contact portions 141 of the contacts 14, patterns connecting from the contact portions of the card to circuits, and connection portions adapted to be connected to integrated circuits and central processing units mounted on the patterns. Cards 60 to be used for the card connector 10 according to the invention include Multimedia card (registered trademark), SD card (Secure Digital memory card) (registered trademark), Mini-SD card (Mini Secure Digital memory card) (registered trademark), Memory Stick card (registered trademark), SmartMedia card (registered trademark), CompactFlash card (registered trademark), xD card (registered trademark), RS-MMC card (Reduce Size MMC card) (registered trademark), Transflash card (registered trademark), S card (registered trademark), Memory-stick Duo card (registered trademark) and the like, these being IC cards having built-in CPU or IC for memory.

The card connector 10 in the illustrated embodiment is configured to have a structure into which a CompactFlash card (CF card) (registered trademark) can be inserted.

The components of the card connector will be explained. First, referring to FIGS. 1A, 1B, 4A and 4B, the terminals 20 will be explained which are concerned with an important aspect of the invention. Said terminals 20 are made of a metal and formed by means of the press-working of the known technique. Preferred metals from which to form the terminals 20 include brass, beryllium copper, phosphor bronze and the like which comply with the requirements as to springiness, electric conductivity and the like. Said terminals 20 are provided on said guide frame 16, one on each of guide portions 162 on both sides of the guide frame 16. Each of said terminals 20 at least comprises a card contact portion 202 adapted to contact said card 60, locking portions 205 adapted to engage said guide frame 16, engaging pieces 204, and a connection leg 203 to be connected to a substrate. Moreover, said terminal 20 to be located on the side of the guide frame 16 provided with said shell 18 and ejector means further comprises an extending piece 201 adapted to contact an extending portion 182 of said shell 18 (see FIG. 3).

As described above, said terminal 20 on the side of the guide frame 16 provided with said shell 18 and ejector means is provided with the extending piece 201 extending in the direction opposite from the connection leg 203 as shown in FIG. 4A. Said extending piece 201 of the terminal 20 is brought into contact with the extending portion 182 of said shell 18 to prevent secondary discharge. The size and shape of said extending piece 201 may be any ones insofar as the extending piece 201 can contact the extending portion 182 of the shell 18 and may be suitably designed in consideration of miniaturization of the connector, and strength and electrically contacting ability of the terminal. In the illustrated embodiment, the extending piece 201 is in the form of a plate and extends on the order of 1.2 mm to 1.6 mm.

As described above, each of said terminals 20 is provided with the connection leg 203 in the form of clevis or yoked type extending (on the connection side to the substrate) in the direction opposite from said extending piece 201. Said connection leg 203 is made to be a clevis-shape to provide a springiness to it which makes it easy to fix (or insert) the terminal to (or into) the substrate. The shape of the connection leg 203 may be any one which enables the terminal 20 to be fixed to or inserted into the substrate and may be suitably designed in consideration of its strength and function.

As described above, each of said terminals 20 is provided with the card contact portion 202 extending onto the card insertion side and adapted to contact said card 60. The term "the card insertion side" used herein means the side of a fitting opening 28 of the housing for inserting the card 60 into the card connector 10. When the card contact portion 202 contacts said card 60, static electricity flows through said terminals 20 into the substrate. The shape and size of said card contact portion 202 may be any ones so long as the card contact portion 202 can contact said card 60 and may be suitably designed in consideration of the function (causing the static electricity to flow to the substrate), electrically contacting ability, strength, and the like. It is desirable to bend the tips of the card contact portions 202 in a manner facilitating the contact with said card 60 without scratching the card 60.

As described above, each of said terminals 20 is provided with locking portions 205 which are substantially U-shaped for the purpose of engaging and fixing the terminal 20 to said guide frame 16. Said locking portions 205 need only be able to engage said guide frame 16, thereby enabling the terminal 20 to be fixed to the guide frame 16, and may be suitably designed in consideration of the springiness, strength and the like of the terminal 20. The two locking portions 205 of the terminal are formed as shown in the drawings by cutting one locking portion at its middle to provide elasticity to the locking portions 205.

As described above, each of said terminals 20 is provided with the engaging pieces 204 substantially L-shaped on both the sides in the width direction on the opposite side of said locking portions 205 for the purpose of holding said terminal 20 in the vertical direction. Said engaging pieces 204 cooperate with said locking portions 205 to fix said terminal 20 in its vertical position to said guide frame 16. The shape and size of the engaging pieces 204 may be any ones insofar as the terminal 20 can be fixed thereat and may be suitably designed in consideration of the function and strength of the engaging pieces 204.

Said shell 18 will then be explained which is another important aspect of the invention. Said shell 18 is made of a metal and formed by means of the press-working of the known technique. Preferred metals from which to form said shell 18 include brass, beryllium copper, phosphor bronze and the like which comply with the requirements as to workability, strength, electric conductivity, manufacturing cost, and the like. As shown in FIG. 5, said shell 18 has a substantially U-shaped cross-section and at least comprises the extending portions 182 adapted to contact the extending piece 201 and the connection leg 203 of said terminal 20, respectively, an engaging recess 181 covering part of said guide frame 16 accommodating the card removing means, and an urging piece 183 for urging said heart cam plate 34.

Said shell 18 serves to enclose the integral unit including said ejector button 30, said cam pin plate 32, said heart cam plate 34, and said elastic body 36. For this purpose, said shell 18 includes the engaging recess 181 as shown in FIG. 5 into which the integral unit including said ejector button 30, said cam pin plate 32, said heart cam plate 34, and said elastic body 36 can be inserted. The shape and size of said engaging recess 181 may be any ones so long as the integral unit including said ejector button 30, said cam pin plate 32, said heart cam plate 34, and said elastic body 36 can be inserted into the engaging recess 181, and the shell 18 can be fixed to said guide frame 16, and may be suitably designed in consideration of the workability, strength, electric conductivity, cost and the like.

As described above, the shell is provided with the urging piece 183 in the engaging recess 181 for urging said heart cam plate 34 toward said cam pin plate 32. The shape, size and position of said urging piece 183 may only need to be able to urge said heart cam plate 34 toward said cam pin plate 32 and may be suitably designed in consideration of such a function, its springiness, strength and the like.

As shown in FIGS. 3, 5 and 12 and as described above, said shell 18 is provided with the extending portion 182 adapted to contact the extending piece 201 of said terminal. Said extending portion 182 is provided at the location making it possible to contact the extending piece 201 of said terminal 20. The shape and size of said extending portion 182 may need only be able to contact said extending piece 201 and may be suitably designed in consideration of the strength, contact force, continuity, workability and the like. In the illustrated embodiment, the extending portion 182 extends in a substantially trapezoid manner.

In order to vertically hold said terminal 20, it is desirable to provide the extending portions 182 on both the sides of the U-shaped cross-section.

Said housing 12 will then be explained. The housing 12 is formed from an electrically insulating plastic material by means of the injection molding of the known technique. The materials for the housing 12 may be suitably selected in consideration of dimensional stability, workability, manufacturing cost, and the like and in generally include polybutylene terephthalate (PBT), polyamide (66PA or 46PA), liquid crystal polymer (LCP), polycarbonate (PC) and the like and combination thereof. As shown in FIG. 6, said housing 12 is substantially hexahedral and is formed with inserting holes 12 into which said contacts 14 are inserted. The shape and size of said inserting holes 12 may need only be able to hold said contacts 14 and may be suitably designed in consideration of the shape and size of said contacts 14 and strength and the like of said housing 12. Moreover, said housing 12 is provided with holes, one at each of the longitudinal ends, for inserting said fixtures 38.

Said contacts 14 will then be explained. Said contacts 14 are made of a metal and formed by means of the press-working of the known technique. Preferred metals from which to form the contacts 14 include brass, beryllium copper, phosphor bronze and the like which comply with the requirements as to springiness, electric conductivity and the like. As shown in FIG. 7, said contact 14 is substantially crank-shaped and at least comprises a contact portion 141 adapted to contact said card 60, a fixed portion to be held in said housing 12, and a connection portion 143 to be connected to a substrate (not shown). The contacts 14 are fixed to the housing 12 by press-fitting, hooking (lancing) or the like such that the contact portions 141 extend from the housing 12 into its fitting opening 28. Extending distances of said contact portions 141 into said fitting opening 28 may be suitably designed in consideration of specifications and the like of said card 60.

Referring to FIGS. 8A and 8B, the guide frame 16 is explained. Said guide frame 16 is formed from an electrically insulating plastic material by means of the injection molding of the known technique. The materials for the guide frame 16 may be suitably selected in consideration of dimensional stability, workability, manufacturing cost, and the like and in generally include polybutylene terephthalate (PBT), polyamide (66PA or 46PA), liquid crystal polymer (LCP), polycarbonate (PC) and the like and combination thereof. As shown in FIGS. 8A and 8B, said guide frame 16 is substantially U-shaped and at least comprises guide portions 162 arranged in the longitudinal direction symmetrically with respect to the inserting direction of the card, and a jointing portion 161 for connecting the guide portions 162.

Said guide frame 16 and said housing 12 cooperate with each other to form the fitting opening 28 for inserting said card 60. Each of said guide portions 162 arranged in symmetry is formed in the inner side with a guide groove 163 for guiding said card 60 to said contacts 14. The size and shape of said guide grooves 163 may need only be able to guide said card 60 to said contacts 14 and may be suitably designed in consideration of such a function, the shape and size of said card 60, the strength of said guide portions 162, and the like.

Moreover, each of said guide portions 162 is provided at the end remote from the card insertion side with a card abutment surface 164 against which said card 60 abuts. The guide portion 162 and the card abutment surface 164 form a substantially L-shape. Said card abutment surfaces 164 also serve as positioning means for said slider plate 22 whose pushing-out pieces 222 (later described) abut against the card abutment surfaces 164, respectively.

Further, each of said guide portions 162 is provided with a projection 168 on the side of said card abutment surface 164, which is adapted to engage a hole 265 of said metal frame 26, for positioning the metal frame 26 relative to the guide frame 16 by the engagement of the projections 168 with the holes 265 of the metal frame 26.

Referring also to FIGS. 4A and 4B, each of said guide portions 162 is formed with a hole 167 on the card insertion side, through which the card contact portion 202 of said terminal 20 extends into said fitting opening 28. The size and shape of said holes 167 need only allow the card contact portions 202 to extend therethrough, and may be suitably designed in consideration of the strength of the guide portions and the function of the holes 167. In the illustrated embodiment, the holes 167 are rectangular for facilitating forming of the holes 167.

Moreover, each of said guide portions 162 is provided in the proximity of said hole 167 with latches 165 with which the locking portion 205 of said terminal 20 is engaged and with anchoring grooves 166 with which said engaging pieces 204 are engaged, respectively. The sizes and shapes of said latches 165 and said anchoring grooves 166 only need to permit said terminals 20 to be vertically held and may be suitably designed in consideration of their functions, the strength and workability of the guide portions 162.

Positions of said latches 165, said anchoring grooves 166, and said holes 167 may be suitably designed in consideration of the functions of said terminals 20 (the approach to static electricity), strengths and the like.

Said slider plate 22 will then be explained. Said slider plate 22 is made of a metal and formed by means of the press-working of the known technique. Preferred metals from which to form said slider plate 22 include brass, beryllium copper, phosphor bronze and the like which comply with the requirements as to workability, strength, electric conductivity, slidability, and the like. As shown in FIG. 9, said slider plate 22 is a substantially plate-shaped piece and at least comprises the pushing-out pieces 222 for pushing out said card 60, guide pieces 223 for moving said slider plate 22 in a direction parallel to the inserting direction of said card 60, anchoring pieces 224 adapted to engage said metal frame 26, and an anchoring projection piece 221 adapted to engage said slider arm 24.

Said slider plate 22 is a member for removing said card 60 and has the substantially L-shaped pushing-out pieces 222 at both the longitudinal ends for pushing out said card 60. Said pushing-out pieces 222 need only be able to push out said card 60 and may be suitably designed in consideration of their function, the strength, balancing upon pushing out, and the like.

Moreover, as described above said slider plate 22 is provided at the middle of its length with the anchoring projection piece 221 adapted to engage the engaging hole 243 of said slider arm 24. By the engagement of said anchoring projection piece 221 with said engaging hole 243, said slider plate 22 and said slider arm 24 are connected to each other so that said slider plate 22 is moved in conjunction with the movement of said slider arm 24.

As described above, said slider plate 22 is provided at both the longitudinal ends with the anchoring pieces 224 adapted to engage anchoring holes 264 of said metal frame 26 and further with the guide pieces 223. Said guide pieces 223 are brought into contact with the side surfaces of the guide portions 162 of said guide frame 16 so that said slider plate is moved in a direction parallel to the inserting direction of said card. Said anchoring pieces 224 engage the anchoring holes 264 of said metal frame 26 so that the slider plate 22 is moved in the direction parallel to the inserting direction of said card and is prevented from moving in the direction of thickness of the slider plate 22. The sizes and shapes of said guide pieces 223 and said anchoring pieces 224 may be suitably designed in consideration of these functions, strength, workability, slidability and the like. In the illustrated embodiment, as shown in FIG. 9 said guide pieces 223 are plate-shaped pieces which extend onto the side opposite to the card insertion side and have a bent tip. As shown in FIG. 9, moreover, said anchoring pieces 224 are plate-shaped pieces which extend onto the card insertion side and have an extended tip.

The positions of said guide pieces 223 and said anchoring pieces 224 may be suitably designed in consideration of the functions described above, high slidability, the balancing upon sliding, and the like.

Said slider arm 24 will then be explained. Said slider arm 24 is made of a metal and formed by means of the press-working of the known technique. Preferred metals from which to form said slider arm 24 include brass, beryllium copper, phosphor bronze and the like which comply with the requirements as to workability, strength, electric conductivity, pivotally (rotationally) movable property, and the like. As shown in FIG. 10, said slider arm 24 is substantially a plate-shaped piece and at least comprises the engaging hole 243 adapted to engage the anchoring projection piece 221 of said slider plate 22, a bearing hole 242 to be fitted with a punched out projection 262 of said metal frame 26 so as to support said slider arm 24 by said projection 262, and a pressure receiving piece 241 adapted to be urged by an urging surface 322 of said cam pin plate.

As described above, said slider arm 24 is provided at one end with the pressure receiving piece 241 extending onto the card insertion side and adapted to be urged by the urging surface 322 of said cam pin plate 32 and at the other end with the engaging hole 243 adapted to engage the anchoring projection piece 221 of said slider plate 22. The shapes and the sizes of said pressure receiving piece 241 and said engaging hole 243 may be suitably designed in consideration of their functions, smooth pivotal movement and strength of the slider arm 24 and the like.

As described above, said slider arm 24 is formed at the middle of its length with the bearing hole 242 to be fitted with the projection 262 of said metal frame 26 for supporting the slider arm 24 relative to the metal frame 26. The shape and size of said bearing hole 242 need only be able to support said slider arm 24 by said projection 262 of the metal frame 26, and may be suitably designed in consideration of the function, strength and workability of the slider arm 24.

As described above, the projection 262 of said metal frame 26 is fitted in the bearing hole 242 of said slider arm 24 so as to support the slider arm 24 by the projection 262 of said metal frame 26, and the engaging hole 243 of said slider arm 24 is engaged with the anchoring projection piece 221 of said slider plate 22 so that said slider plate 22, said slider arm 24 and said metal frame 26 are connected to one another. In this way, when said slider arm 24 is pivotally moved about the projection 262 of said metal frame 26, said slider plate 22 is also moved in conjunction with such a pivotal movement.

Said metal frame 26 will then be explained. Said metal frame 26 is made of a metal and formed by means of the press-working of the known technique. Preferred metals from which to form said metal frame 26 include brass, beryllium copper, phosphor bronze and the like which comply with the requirements as to workability, strength, electric conductivity and the like. As shown in FIG. 11, said metal frame 26 is substantially U-shaped and at least comprises engaging grooves 261 adapted to engage the guide portions 162 of said guide frame 16, respectively, the projection 262 to be fitted in the bearing hole 242 of said slider arm 24, the anchoring holes 264 adapted to engage the anchoring pieces 224 of said slider plate 22, respectively, and contact pieces 263 adapted to contact said card 60.

Said metal frame 26 is provided at both longitudinal ends with engaging portions 266 having a U-shaped cross-section and extending onto the card insertion side. Each of said engaging portions 266 is provided at the tip with a contact piece 263 adapted to contact the upper surface of said card 60.

Each of said engaging portions 266 having the U-shaped cross-section is provided with the engaging groove 261 adapted to engage part of the guide portion 162 of said guide frame 16. The size and shape of said engaging groove need only be able to engage the part of the guide portion 162 of said guide frame 16 and may be suitably designed in consideration of the size of the guide portion 162, miniaturization and strength of the card connector.

Each of said engaging portion 266 is formed with the anchoring hole 264 adapted to engage the anchoring piece 224 of said slider plate 22 and the hole 265 adapted to engage the projection 168 of said guide frame 16. The size and shape of said anchoring holes 264 and said holes 265 may be suitably designed in consideration of the functions described above, the strength, workability and the like of the metal frame 26.

Moreover, said metal frame 26 is provided with the projection 262 at a location corresponding to the bearing hole 242 of said slider arm 24 to be fitted in the bearing hole 242. The projection 262 of said metal frame 26 is fitted in the bearing hole 242 of said slider arm 24 so as to support the slider arm 24 by the projection 262 of said metal frame 26, and the engaging hole 243 of said slider arm 24 is engaged with the anchoring projection piece 221 of said slider plate 22 so that said slider plate 22, said slider arm 24 and said metal frame 26 are connected to one another. In this way, when said slider arm 24 is pivotally moved about the projection 262 of said metal frame 26, said slider plate 22 is also moved in conjunction with such a pivotal movement.

The integral unit of said shell 18 including said ejector button 30, said cam pin plate 32, said heart cam plate 34, and said elastic body 36 will then be explained with reference to FIG. 12. As shown in FIG. 12, the integral unit is substantially hexahedral and serves to eject said card 60 from the card connector. Said ejector button 30, said cam pin plate 32, and said heart cam plate 34 are formed from an electrically insulating plastic material by means of the injection molding of the known technique. The materials for these members may be suitably selected in consideration of dimensional stability, workability, manufacturing cost, and the like and in generally include polybutylene terephthalate (PBT), polyamide (66PA or 46PA), liquid crystal polymer (LCP), polycarbonate (PC) and the like and combination thereof. Said elastic body 36 is made of a metal, and commercially available coil springs are used for the elastic body depending upon customer's specifications.

Said ejector button 30 is substantially hexahedral and provided at one end with an actuating portion 302 and at the other end with a pin 301. Said cam pin plate 32 is also substantially hexahedral and provided at one end with a hole 321 and at the other end with the urging surface 322 and a moving pin 323. Said heart cam plate 34 is also substantially hexahedral and is provided at one end with an extending pin (not shown) adapted to engage said elastic body 36 and at the other end with a heart cam groove 341.

Said ejection button 30, said cam pin plate 32, said heart cam plate 34 and said elastic body 36 are integrally combined with one another in a manner such that the pin 301 of said ejector button 30 engages the hole 321 of said cam pin plate 32, and the moving pin 323 of said cam pin plate 32 engages the heart cam groove 341 of said heart cam plate 34, and that the extending pin 342 of said heart cam plate 34 engages said elastic body 36, and said elastic body 36 is embraced by said heart cam plate 34 and said ejector button 30.

The fixtures 38 will then be explained. Said fixtures 38 are made of a metal and formed by means of the press-working of the known technique. Preferred metals from which to form said fixtures 38 include brass, beryllium copper, phosphor bronze and the like which comply with the requirements as to workability, dimensional stability, and the like.

Said fixtures 38 serve to increase the fixing (holding) strength when said card connector 10 is fixed to a substrate, and each comprise a fixed portion 381 to be fixed to said housing 12 and a connection portion 382 to be connected to the substrate.

Finally, the method for ejecting said card 60 from the card connector 10 will be explained. First, under the condition that said card 60 has been inserted into said card connector 10 as shown in FIG. 2A, the actuating portion 302 of said ejector button 30 is pushed into the inserting direction of said card so that the moving pin 323 of said cam pin plate 32 integrally incorporated in the integral unit moves in the heart cam groove 341 of said heart cam plate 34.

As a result of such a movement of the moving pin 323 in said heart cam groove 341, the urging surface 322 of said cam pin plate 32 pushes the pressure receiving piece 241 of said slider arm 24 into the inserting direction of said card. As described above, the slider arm 24 is pivotally mounted on said metal frame 26 whose projection 262 is fitted in the bearing hole 242 of the slider arm 24. Consequently, upon the pressure receiving piece 241 being pushed, the slider arm 24 is pivotally moved about the projection 262 of the metal frame 26.

Since said anchoring projection piece 221 of the slider plate 22 engages the engaging hole 243 of said slider arm 24, the pivotal movement of said slider arm 24 causes said slider plate 22 to move in a direction in parallel with the card moving direction. Said slider plate 22 is moved in the direction parallel to the card moving direction so that the pushing-out pieces 222 of said slider plate 22 push said card 60 in the direction opposite to the inserting direction of the card, thereby removing said card from the card connector 10. When the slider plate 22 is moved in the direction parallel to the card moving direction, the slider plate 22 is assuredly moved with the aid of its guide pieces 223 and the anchoring pieces 224.

Examples of applications of the present invention are card connectors for use in electronic or electric appliances such as personal computers, printers and the like, and more particularly card connectors having means with which to prevent troubles caused by electrostatic discharge (ESD).

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A card connector into and from which a card is inserted and removed, including a plurality of contacts each having a contact portion adapted to contact said card, a housing arranging and holding said contacts and having a fining opening into which said card is inserted, a guide frame formed integrally with or separately from said housing and having guide portions for guiding said card to said contacts, a shell enclosing a portion of said guide frame in which a card removing means is installed, terminals arranged on a side of a leading end of said fitting opening for providing a conductive path for discharging static electricity, and the card removing means for removing said card from said card connector, wherein at least one of said terminals is provided with an extending piece and a connection portion which connects each of said at least one terminals to a substrate, said extending piece extending from each of said at least one of said terminals in a direction opposite from the connection portion, and said shell is provided with an extending portion adapted to contact said extending piece of said terminal.

2. The card connector as set forth in claim 1, wherein said extending portion of said shell is positioned on a side thereof, and opposite from a portion of said guide frame where said extending piece of said terminal is positioned for preventing said terminal from tilting.

* * * * *